United States Patent [19]

Peeters Weem et al.

[11] Patent Number: 4,630,856

[45] Date of Patent: Dec. 23, 1986

[54] TWISTLOCK OPERATING MECHANISM

[75] Inventors: Jan A. Peeters Weem, Gresham; David E. Krueger, Mulino; Dennis P. Graham, Milwaukie, all of Oreg.

[73] Assignee: Hyster Company, Portland, Oreg.

[21] Appl. No.: 697,039

[22] Filed: Jan. 31, 1985

[51] Int. Cl.[4] ..... B66C 1/42

[52] U.S. Cl. ..... 294/81.53; 294/907

[58] Field of Search ..... 294/81.53, 81.1, 67.1, 294/68.1, 68.3, 86.4, 67.3, 907; 414/608, 620, 621, 730

[56] References Cited

U.S. PATENT DOCUMENTS

| | | | |
|---|---|---|---|
| 3,493,258 | 2/1970 | Wyrough | 294/67 |
| 3,871,697 | 3/1975 | Bechtloff | 294/81.53 |
| 3,885,676 | 5/1975 | Wilson | 212/44 |
| 3,892,436 | 7/1974 | Fathauer | 294/81 |
| 4,245,271 | 1/1981 | Gwin | 361/189 |
| 4,396,218 | 8/1983 | Stevens | 294/81.53 |
| 4,402,543 | 9/1983 | Simpson | 294/81 |
| 4,444,426 | 4/1984 | Taylor | 294/81 |

*Primary Examiner*—James B. Marbert

*Attorney, Agent, or Firm*—Tim A. Long

[57] ABSTRACT

Twistlocks of a container spreader are operated and controlled by hydraulic cylinders and interlock valves connected in series. Interlock valves block the flow of fluid through the cylinders when insertion of the twistlocks in their mating connectors is incomplete. Parallel fluid ports at the inlet and outlet of the cylinders permit the inlet and outlet to be connected, at the ends of the hydraulic cylinder's piston stroke, to compensate for different volume requirements of the hydraulic cylinders.

14 Claims, 7 Drawing Figures

TWISTLOCK OPERATING MECHANISM

BACKGROUND OF THE INVENTION

1. Field of the Invention

The field of art to which this invention pertains includes cargo handling devices and more specifically the means of actuation and control of the twistlocks of a container lifting spreader.

2. Description of Related Art

The handling of large freight containers is a common activity in the freight transportation industry. These containers are handled by specialized load handling attachments, known as spreaders, which are mounted on various types of machines; including cranes, straddle carriers and large lift trucks. The spreader is a beam, often capable of telescoping to handle containers of different lengths, which is releasably coupled to the container by rotatable twistlocks mounted at the ends of the beam in position for insertion into mating connectors formed by oval apertures in castings at the corners of the containers. After insertion, the twistlocks are rotated, commonly by hydraulic cylinder assemblies, to a locked position to couple the container to the spreader for lifting.

Since the container and the handling machine may be supported in different planes, proper insertion of the twistlocks in all corner castings is not automatially assured. Likewise, the operator may have difficulty determining whether a corner of the container remains supported by one, or more, twistlocks when depositing the container. Many spreaders include an interlock to prevent the rotation of the twistlocks to the locked or unlocked position unless the twistlocks have been inserted fully in the corner castings and there is no weight bearing on a twistlock.

In the prior art, both mechanical and electrical interlocks have been utilized. An electrical interlock is disclosed in U.S. Pat. No. 3,885,676. Electrical switches detect contact of the spreader with the container at the twistlock locations. When the switches all indicate contact, a circuit is closed through appropriate relays to a solenoid operated hydraulic valve. The operator, by actuation of a switch, causes the shifting of the hydraulic valve to direct fluid to hydraulic cylinders to rotate the twistlocks. Electrical interlock systems are complex and expensive; requiring components to prevent the system from being affected by extraneous electromagnetic fields or power interruption, large solenoid operated hydraulic valves and some means of providing electrical power at the ends of the spreader which may telescope to handle different lengths of containers. The effects of moisture and salt, present in the air at marine terminals, on electrical components can result in costly maintenance requirements for these systems.

Mechanical interlocks; such as disclosed in U.S. Pat. No. 4,402,543; are less complex and costly than the electrical interlock. In this interlock a spring biased pin mechanically interferes with the rotation of the twistlock unless the pin is depressed by the weight of the spreader when it contacts the container at the twistlock locations. The pin must resist the full force of the twistlock rotating mechanism and force limiting devices may be required to avoid overriding the interlock or damaging the rotating mechanism. Further, if the operator should attempt to operate the twistlock before the pin is completely depressed, the pin may bind and fail to operate properly.

SUMMARY OF THE INVENTION

This invention provides a twistlock operating mechanism with a reliable interlock of simple and inexpensive construction. This is accomplished by providing mechanially operated interlock valves and hydraulic cylinder assemblies, to provide power to rotate the twistlocks, arranged in a series circuit. The interlock valves in the closed position, block the flow of hydraulic fluid through the twistlock operating circuit. A pin, located at each twistlock location, is depressed by the weight of the spreader when contact is made with the container, opening the interlock valve. With all interlock valves open, hydraulic fluid can flow through an interlock valve to the piston of a hydraulic cylinder. Fluid expelled by the movement of the piston flows through interlock valves to the piston of a second hydraulic cylinder causing it to move. Fluid expelled by the second hydraulic cylinder returns to the reservoir through another interlock valve. If any interlock valve is closed, fluid flow can not progress in the series circuit and twistlock rotation is prevented. A means to compensate for differences in the fluid volume requirements of the hydraulic cylinders, in the series circuit, is provided. Parallel fluid ports at the hydraulic cylinder inlets and outlets permit fluid to flow through the circuit if the piston of one hydraulic cylinder should reach the end of its stroke before the other.

A main object of this invention is to provide an improved interlock for a twistlock operating mechanism. Further objects, features and advantages of the invention will be understood by persons skilled in the art when the following detailed description is reviewed in conjunction with the drawings.

BRIEF DESCRIPTION OF THE DRAWINGS

The invention is described with reference to the accompanying drawings, where.

DETAILED DESCRIPTION OF THE PREFERRED EMBODIMENT

Figure 1:
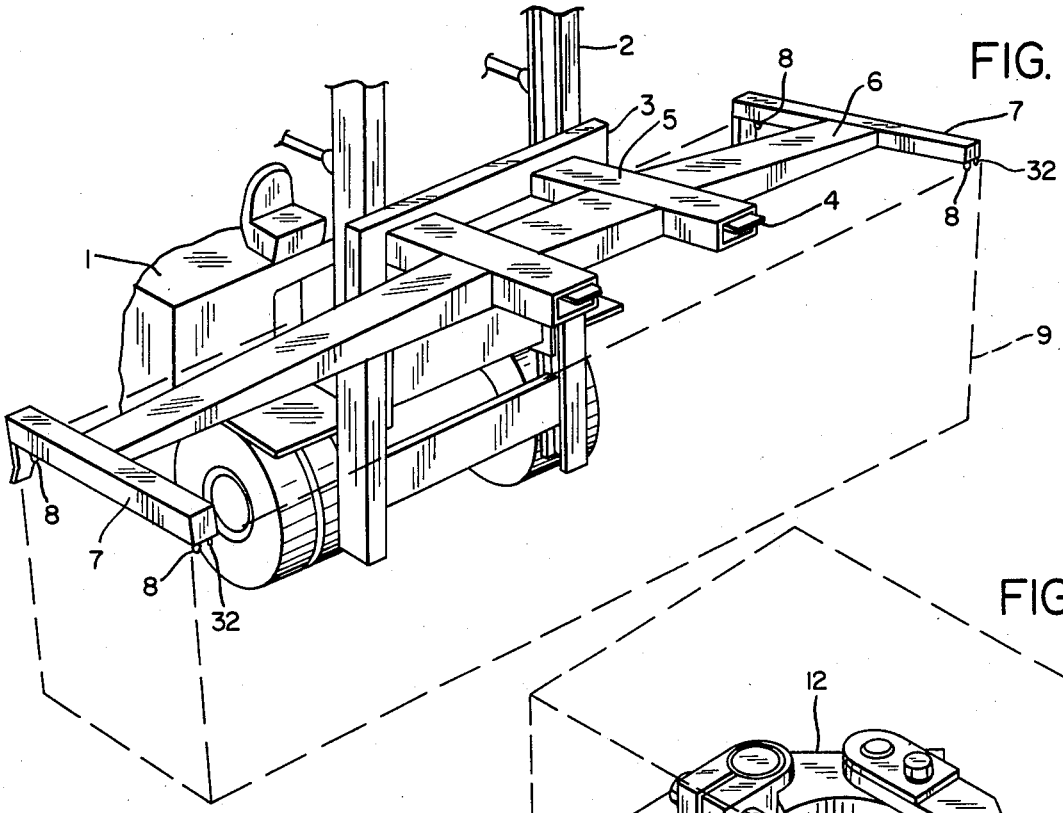
FIG. 1 shows a lift truck with a spreader.

A lift truck 1 having a mast assembly 2 and a carriage 3, arranged for vertical movement in the mast assembly, is shown in FIG. 1. Forks 4 attached to the carriage support a spreader, indicated generally at 5. The spreader comprises, generally, a hollow center beam 6, positioned transverse to the longitudinal axis of the lift truck, with an end beam 7, arranged parallel to the longitudinal axis of the lift truck, attached to each end of the center beam. At the ends of each end beam is a twistlock 8, positioned for engagement with a mating connector formed by an oval aperture in a hollow casting at each corner of the top of a container 9.

Figure 3:
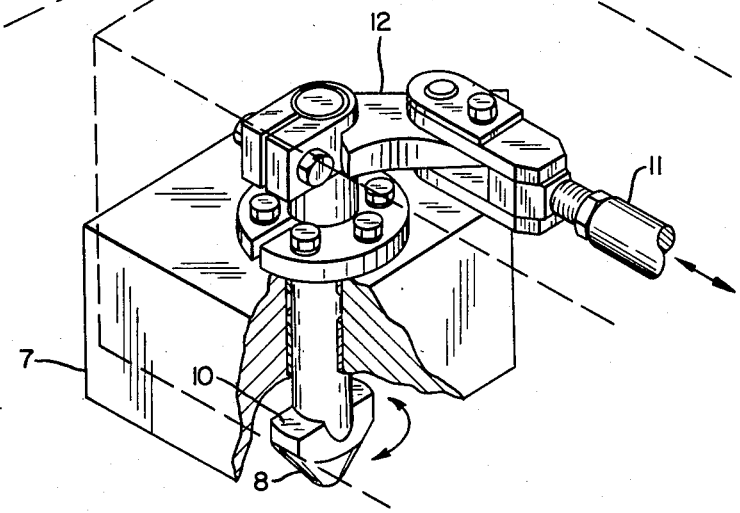
FIG. 3 shows a twistlock mounting.

To engage a container, for lifting, the twistlocks are rotated to an unlocked position with the longer dimension of the twistlock shoulder 10, illustrated in FIG. 3, aligned with the longer axis of the oval aperture in the container corner casting. The spreader is lowered and the twistlock is inserted, through the aperture, into the corner casting. When all twistlocks are inserted into corresponding corner castings, the operator directs pressurized fluid to the twistlock operating circuit of the present invention, refer to FIG. 2, to rotate the twistlocks 90° to the locked position. Since the longer dimension of the shoulder of the twistlock cannot be withdrawn through the shorter axis of the oval aperture in the corner casting, the container will be locked to the spreader and lifted on the twistlock shoulders when the spreader is lifted.

Figure 2:
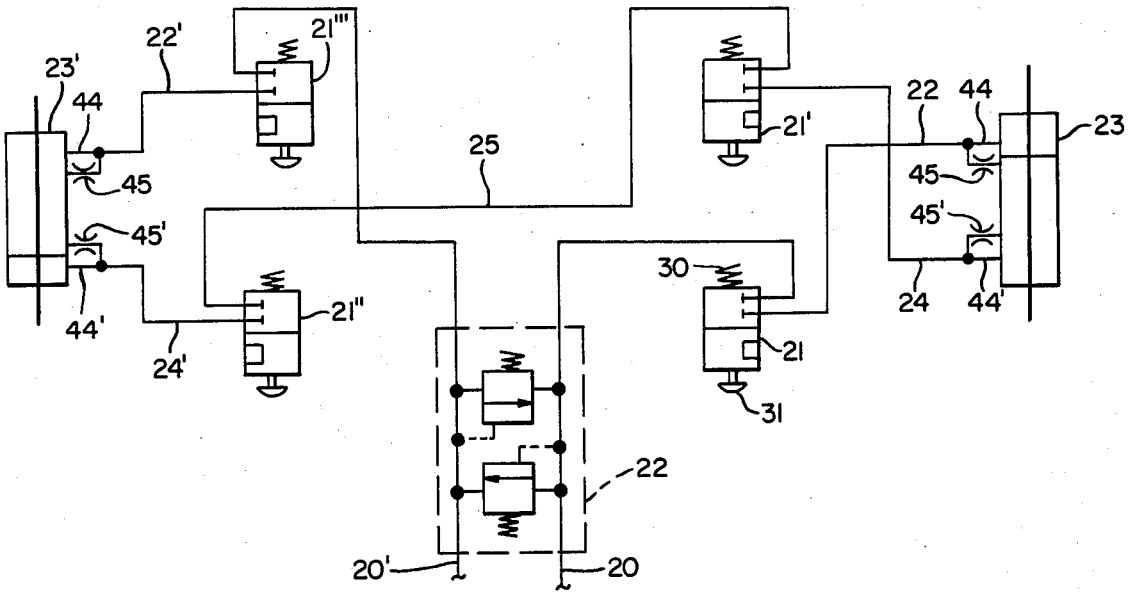
FIG. 2 is a diagram of a hydraulic circuit in accordance with the present invention.
Figure 5:
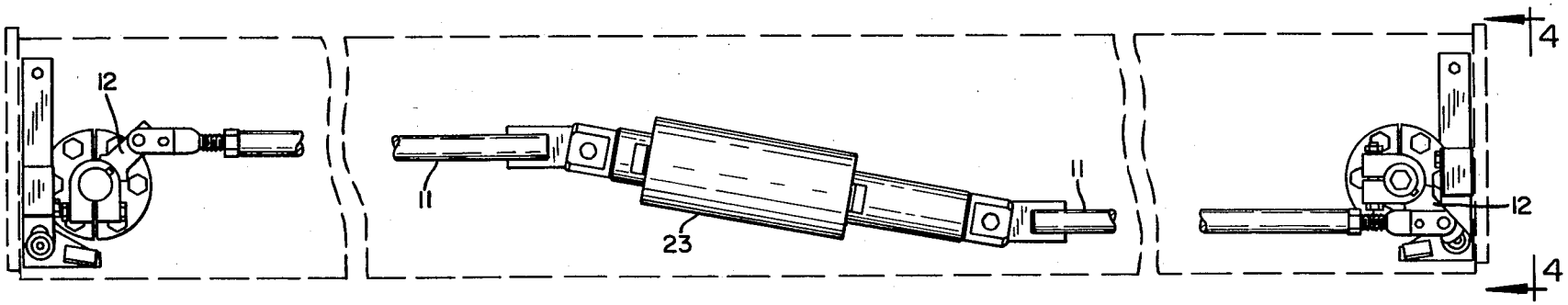
FIG. 5 is a top view of the spreader end beam.
Figure 7:
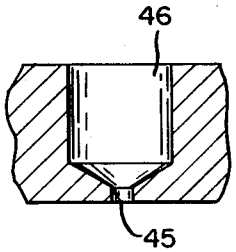
FIG. 7 is a sectional view of the detail of the restricted fluid port of a hydraulic cylinder.
Figure 6:
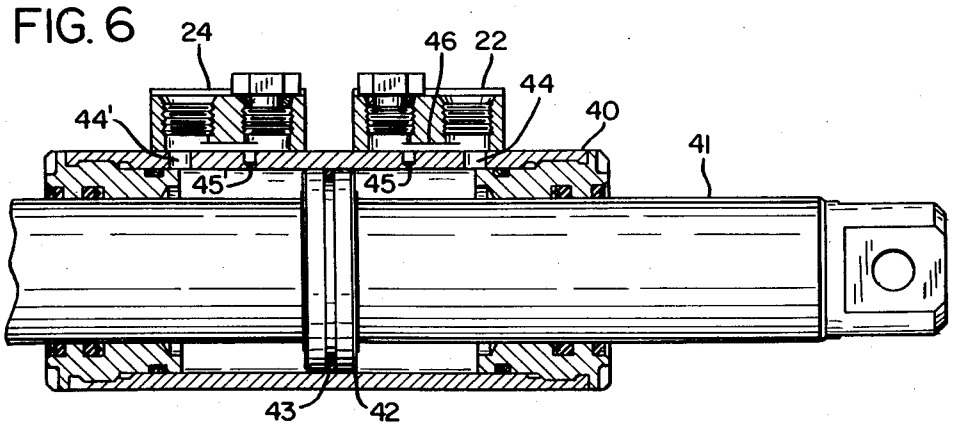
FIG. 6 is a sectional view of a hydraulic cylinder.

Referring to FIG. 2, the twistlock operating mechanism comprises two identical fluid motors 23 and 23' connected in series and a plurality of interlock valves 21, 21', 21'' and 21''', each corresponding to a twistlock, at the inlets and outlets of the motors. The fluid motors are two-way hydraulic cylinders, as illustrated in FIG. 5, attached to each end beam. The hydraulic cylinder, as shown in FIG. 6, comprises a shell 40 with the fluid inlet and outlet comprising two parallel fluid ports means; an unrestricted port 44 and a restricted port 45, illustrated in detail in FIG. 7, at one end of the shell and corresponding fluid ports 44' and 45' at the other. The fluid ports are connected in parallel by passage 46. A piston rod 41 extends from each end of the shell. An enlarged piston 42 with seal 43 is attached to the center of the piston rod. Referring to FIGS. 3 and 5, a link 11 is attached to each end of the piston rod and, in turn, to a crank 12 which is attached to the shaft of one of the pair of twistlocks in each end beam. Stroking of the piston rod will rotate the pair of twistlocks in each end beam.

Figure 4:
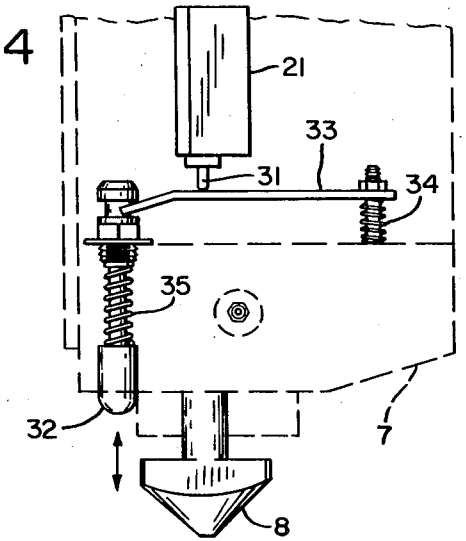
FIG. 4 is an end view, generally along line 6—6 of FIG. 5, of the spreader end beam showing the interlock valve operating mechanism.

The interlock valves are two-position hydraulic valves which are biased to the closed position by a spring 30 in the valve. To open the valve and permit flow, the valve plunger 31 is depressed. Referring to FIG. 4, the interlock valve 21 is opened by the operation of an indicator pin 32 located adjacent to the twistlock. The plunger 31 of the interlock valve engages a lever 33 supported at one end by an overtravel spring 34 and at the other by a shoulder on the indicator pin. The indicator pin is biased to an extended position by a spring 35. When the twistlock is inserted into the corner casting the top surface of the casting can contact the indicator pin and if the spreader is lowered, the weight of the spreader will depress the indicator pin. The lever will react against the overtravel spring and be pivoted upward by the movement of the indicator pin. The interlock valve plunger will be depressed opening the valve. The length of the indicator pin is selected such that when the container is lifted on the twistlock shoulder, there will be sufficient distance between the end beam 7 and the top of the corner casting to permit the indicator pin to again be extended by the spring closing the interlock valve. Thus, the interlock valve will be closed unless the end beam is in contact with the corner casting at the corresponding twistlock.

MODE OF OPERATION

Referring to FIG. 2, the twistlock operating circuit is shown with the twistlocks in the unlocked position. To lock the twistlocks, the operator, by actuation of a manual control valve (not shown) directs pressurized fluid to supply line 20. The flow of fluid in the supply line is blocked, however, by a first interlock valve 21. Pressure will rise in the supply line until the double relief valve 22 opens permitting the flow of fluid through the relief valve into line 20' and back to the reservoir (not shown) on the lift truck.

If interlock valve 21 is open, pressure will be supplied, through line 22 to the first of the two hydraulic cylinder assemblies 23 connected in series. Pressurized fluid supplied through line 22, FIG. 2, can enter the hydraulic cylinder shell through the parallel ports; an unrestricted port means 44 and a restricted port means 45. Fluid pressure will urge the piston to stroke, expelling fluid through line 24. Flow out of cylinder 23 cannot occur, however, unless interlock valves 21' and 21'' are open, indicating proper insertion of their respective twistlocks. If interlock valves 21' and 21'' are open, fluid pressure is communicated to cylinder 23' through lines 24, 25 and 24'. Fluid cannot be expelled from hydraulic cylinder 23 to drive the piston of hydraulic cylinder 23' unless interlock valve 21''' is also open, indicating complete insertion of its corresponding twistlock, permitting fluid to be expelled, by the movement of the piston of cylinder 23', through lines 22' and 20' to the reservoir. Thus, if any twistlock has not completely penetrated its respective corner casting, the corresponding interlock valve will remain closed, with fluid flowing through the relief valve, and twistlock rotation cannot occur.

The hydraulic cylinder assemblies 23 and 23' are of the same displacement. Fluid expelled by the driving cylinder, for example 23, will be the correct volume to cause complete stroking of the driven cylinder 23'. Manufacturing tolerances or minor leakage could, however, cause too little or too much fluid to be expelled to complete the stroking of the driven cylinder. The parallel fluid ports at the inlet and outlet of the cylinder shells provide a means to compensate for potential unequal volume requirements to prevent a pair of twistlocks from stopping short of full rotation to the locked or unlocked position. Both parallel ports; for example 44 and 45, FIG. 6; at one end of the cylinder shell are in communication with fluid in the shell on the same side of the piston except when the piston reaches the end of its stroke. As the pistion approaches the end of its stroke, the seal 43 will pass the restricted port 45 or 45' at that end of the cylinder shell and the restricted and unrestricted ports at one end of the cylinder will be in communication with fluid on opposite sides of the piston. The orifice of the restricted port is sized to maintain sufficient pressure at the unrestricted port, with the piston in the position shown in FIG. 2, to cause the piston to begin to stroke and to continue to stroke when port 45' is in communication with fluid entering from line 22. If cylinder 23 should stroke fully before the driven cylinder 23' completes its stroke, fluid can continue to flow into line 24 through restricted port 45' to cause cylinder 23' to complete its stroke. Likewise, if the driven cylinder 23' should complete its stroke before that of the driving cylinder 23, fluid can flow out of cylinder 23' through restricted port 45 of that cylinder, permitting the piston of cylinder 23 to complete its stroke.

To rotate the twistlocks to the unlocked position, the operator directs pressurized fluid to line 20'. If all interlock valves are open, fluid will flow into cylinder 23' causing its piston to stroke toward the position shown in FIG. 2. Fluid expelled by the movement of the piston flows through lines 24', 25 and 24 to drive the piston of cylinder 23 toward the position shown. As in locking, if any interlock valve is closed, indicating that the weight of the container remains supported by a twistlock, flow through the entire circuit is blocked. The relief valve will open permitting fluid to flow from line 20' to the reservoir through line 20.

Although a specific embodiment of the invention has been shown and described, various changes and alterations might be made without departing from the spirit and broader aspects of the invention as set forth in the claims.

What is claimed is:

1. In a spreader, having a plurality of remotely rotatable twistlocks located for insertion in mating connectors on a container, a twistlock operating mechanism comprising:

(a) a means of directing pressurized fluid from a source to;

(b) the first of a plurality of fluid motors connected in series, each operatively coupled to rotate a twistlock; and (c) a valve means, responsive to twistlock insertion in the corresponding mating connector for selectively blocking the flow of fluid through the motors if a twistlock is not properly inserted.

2. The twistlock operating mechanism of claim 1, further comprising a means, responsive to the rotational position of the twistlocks, to compensate for unequal fluid volume requirements of the fluid motors.

3. The twistlock operating mechanism of claim 2, wherein the means to compensate for unequal fluid motor volume requirements comprises a means to selectively connect the inlet and outlet of a motor in response to the rotational position of the twistlock rotated by the motor.

4. The twistlock operating mechanism of claim 1 wherein the fluid motors comprise hydraulic cylinder assemblies.

5. The twistlock operating mechanism of claim 4 further comprising a means responsive to the rotational position of the twistlocks to compensate for unequal fluid volume requirements of the hydraulic cylinder assemblies.

6. The twistlock operating mechanism of claim 5 wherein the means to compensate for unequal fluid volume requirements of the hydraulic cylinder assemblies comprises a means to selectively connect the inlet and outlet of a hydraulic cylinder assembly in response to the rotational position of the twistlock rotated by the hydraulic cylinder assembly.

7. The twistlock operating mechanism of claim 6 wherein the means to selectively connect the inlet and outlet of a hydraulic cylinder assembly in response to the rotational position of the driven twistlock comprises a fluid inlet or outlet having:

(a) an unrestricted port means in parallel with, (b) a restricted port means which is in communication with fluid on the side of the cylinder piston opposite that of fluid at the unrestricted port means at a limit of movement of the cylinder piston.

8. A twistlock operating mechanism for a spreader having a plurality of remotely rotatable twistlocks, positioned for insertion in mating connectors on a container, comprising:

(a) a means of directing pressurized fluid from a source to;

(b) a first valve selectively blocking fluid flow, when a first twistlock is not completely inserted in its corresponding connector, to the inlet of;

(c) a first fluid motor operatively coupled to rotate a pair of twistlocks;

(d) a second valve selectively blocking fluid flow from said first motor when a second twistlock is not completely inserted in its corresponding connector;

(e) a third valve selectively blocking fluid flow, when a third twistlock is not completely inserted in its corresponding connector, from said second valve to;

(f) a second motor operatively coupled to rotate a second pair of twistlocks; and (g) a fourth valve selectively blocking fluid flow from said second motor when a fourth twistlock is not completely inserted in its corresponding connector.

9. The twistlock operating mechanism of claim 8 further comprising a means responsive to the rotational position of the twistlocks, to compensate for differences in fluid volume requirements, to complete twistlock rotation, of said first and second fluid motors.

10. The twistlock operating mechanism of claim 9 wherein the means to compensate for differences in fluid volume requirements of the first and second fluid motors comprises a means for selectively connecting the inlet of the first or second fluid motor to its respective outlet when the twistlocks operated by the motor have completely rotated.

11. The twistlock operating mechanism of claim 8 wherein the fluid motors comprise hydraulic cylinder assemblies.

12. The twistlock operating mechanism of claim 11 further comprising a means, responsive to the rotational position of the twistlocks, to compensate for unequal fluid volume requirements of the hydraulic cylinder assemblies.

13. The twistlock operating mechanism of claim 12 wherein the means to compensate for unequal fluid volume requirements of the hydraulic cylinder assemblies comprises a means to selectively connect the inlet and outlet of a hydraulic cylinder assembly in response to the rotational position of the twistlock rotated by the hydraulic cylinder.

14. The twistlock operating mechanism of claim 13 wherein the means to selectively connect the inlet and outlet of a hydraulic cylinder assembly in response to the rotational position of the driven twistlocks comprises a fluid inlet or outlet having:

(a) an unrestricted port means in parallel with, (b) a restricted port means which is in communication with fluid on the side of the cylinder piston opposite of that of fluid at the unrestricted port means at a limit of movement of the cylinder piston.

* * * * *